US008882709B2

(12) United States Patent
Nagel et al.

(10) Patent No.: US 8,882,709 B2
(45) Date of Patent: Nov. 11, 2014

(54) INJECTION ARRANGEMENT

(75) Inventors: Thomas Nagel, Tharandt (DE); Rene Richter, Tharandt (DE); Robert Witt, Dredsen (DE)

(73) Assignee: Sanofi-Aventis Deutschland GmbH, Frankfurt am Main (DE)

( * ) Notice: Subject to any disclaimer, the term of this patent is extended or adjusted under 35 U.S.C. 154(b) by 173 days.

(21) Appl. No.: 13/383,992

(22) PCT Filed: Jul. 14, 2010

(86) PCT No.: PCT/EP2010/060122

§ 371 (c)(1),
(2), (4) Date: Apr. 30, 2012

(87) PCT Pub. No.: WO2011/006920

PCT Pub. Date: Jan. 20, 2011

(65) Prior Publication Data

US 2012/0220929 A1 Aug. 30, 2012

(30) Foreign Application Priority Data

Jul. 14, 2009 (EP) ..... 09009190

(51) Int. Cl.

| | |
|---|---|
| ***A61M 1/00*** | (2006.01) |
| ***A61M 31/00*** | (2006.01) |
| ***F04B 43/12*** | (2006.01) |
| ***F04B 23/02*** | (2006.01) |

(52) U.S. Cl.

CPC ..... *F04B 43/1253* (2013.01); *F04B 23/028* (2013.01)

USPC ..... 604/151; 604/67

(58) Field of Classification Search

USPC ..... 604/65, 67, 151–153, 890.1, 891.1

See application file for complete search history.

(56) References Cited

U.S. PATENT DOCUMENTS

| | | | | |
|---|---|---|---|---|
| 5,558,639 | A * | 9/1996 | Gangemi et al. | 604/152 |
| 2002/0169439 | A1 | 11/2002 | Flaherty | |
| 2008/0188810 | A1 * | 8/2008 | Larsen et al. | 604/151 |
| 2009/0292247 | A1 * | 11/2009 | Basso et al. | 604/151 |

FOREIGN PATENT DOCUMENTS

| | | | |
|---|---|---|---|
| DE | 19745999 | A1 | 4/1999 |
| DE | 20211621 | U1 | 1/2003 |
| EP | 1045146 | A2 | 10/2000 |
| GB | 2012373 | A | 7/1979 |
| WO | 2004088136 | A2 | 10/2004 |
| WO | 2008040477 | A1 | 4/2008 |

OTHER PUBLICATIONS

Form PCT/IB/326, Notification Concerning Transmittal of International Preliminary Report on Patentability dated Jan. 26, 2012.

* cited by examiner

*Primary Examiner* — Nathan R Price

(74) *Attorney, Agent, or Firm* — McDonnell Boehnen Hulbert & Berghoff LLP

(57) ABSTRACT

The invention relates to a pump unit, replaceably attachable to a reusable backend of an injection arrangement for delivering a liquid medicament, the pump unit comprising a medicament inlet, a medicament outlet and a pump for delivering the liquid medicament from the inlet to the outlet, wherein a medicament container is arranged in the pump unit, wherein a fluid communication between the medicament container and the pump is establishable when the pump unit is attached to the reusable backend.

14 Claims, 1 Drawing Sheet

INJECTION ARRANGEMENT

CROSS REFERENCE TO RELATED APPLICATIONS

The present application is a 35 U.S.C. 371 National Application of PCT/EP2010/060122 filed Jul. 14, 2010, which claims priority to European Patent Application No. 06009190.1 filed Jul. 14, 2009, the entire contents of which are incorporated entirely herein by reference.

FIELD OF INVENTION

The invention relates to a pump unit, replaceably attachable to a reusable backend of an injection arrangement for delivering a liquid medicament. The invention further refers to an injection arrangement comprising the pump unit and a reusable backend according to claim 11.

BACKGROUND

Many medicaments have to be injected into the body. This applies in particular to medicaments, which are deactivated or have their efficiency remarkably decreased by oral administration, e.g. proteines (such as Insulin, growth hormones, interferons), carbohydrates (e.g. Heparin), antibodies and the majority of vaccines. Such medicaments are predominantly injected by means of syringes, medicament pens or medicament pumps.

A compact small scale peristaltic medicament pump is disclosed in DE 19 745 999. The pump comprises a delivery head, a drive unit for the delivery head, and speed control. The pump with the drive unit may be replaceably attached to a reusable backend in order to maintain a clean and sterile treatment by disposing the pump off and replacing it with a clean one after drug delivery.

WO 2008/040477 A1 discloses an injection arrangement with a peristaltic medicament pump, wherein the drive unit is integrated in the reusable backend rather than in the pump unit so the relatively expensive drive unit does not have to be disposed off every time the pump unit is replaced.

It is an object of the present invention to provide an improved pump unit and an injection arrangement.

The object is achieved by a pump unit according to claim 1 and by a injection arrangement according to claim 11.

Preferred embodiments of the invention are given in the dependent claims.

A pump unit according to the invention is replaceably attachable to a reusable backend of an injection arrangement for delivering a liquid medicament. The pump unit comprises a medicament inlet, a medicament outlet and a pump for delivering the liquid medicament from the inlet to the outlet. A medicament container is arranged in the pump unit and connectable to the medicament inlet. A fluid communication between the medicament container and the pump is establishable when the pump unit is attached to the reusable backend. As long as the pump unit is not attached to the reusable backend, the medicament container remains sealed, e.g. by a septum. The fluid communication may be established by mechanically causing a relative advancing movement of the medicament container towards a hollow needle for piercing the septum, the needle attached to the medicament inlet. Integrating the medicament container in the pump unit improves handling and ergonomics of the pump unit since the user has to deal with fewer parts. The overall reliability of the injection device is improved. By keeping the medicament container sealed before attaching the pump unit to the reusable backend, sterility of the content, e.g. a liquid medicament is ensured.

The pump unit may also have at least one hollow injection needle for piercing a patient's (P) skin and administering the medicament or an adapter for attaching the at least one hollow injection needle integrated, thus further reducing the part count.

The needle may be a pen needle or a Luer needle or a micro-needle of a needle array.

The medicament container may have the shape of a standard ampoule or be a container with a flexible wall.

Preferably a flow sensor for determining a volume flow of the medicament is arranged in the pump unit and connectable to a control unit of a reusable backend thus allowing to control the volume of medicament to be delivered.

The flow sensor may be a thermal sensor or a magnetically inductive sensor or an impeller sensor.

The pump may be a peristaltic pump or a gear pump or a diaphragm pump.

The pump unit may further have at least one interface for connecting to a reusable backend. The interface may be one of a mechanical, electrical, optical, acoustic, magnetic and wireless electromagnetic interface. Preferably the interfaces are arranged to be easily disconnectable.

The mechanical interface may be arranged for connecting the pump to a drive unit arranged in a reusable backend, e.g. the mechanical interface having the shape of a gear or a clutch.

The pump unit is one of two major components of an injection arrangement for delivering a liquid medicament, the other major component being a reusable backend, comprising a control unit, a drive unit and an energy source.

The energy source for the drive unit may be a galvanic cell or battery of galvanic cells in case the drive unit comprises an electrical motor. Preferably the energy source is a rechargeable accumulator. The rechargeable accumulator may be replaceable or chargeable in place by an external charging device arranged for holding the reusable backend.

The reusable backend may further have a user interface for user interaction. This may comprise a dosing and/or trigger knob or wheel and/or a display, e.g for displaying a dose volume.

A second septum may be arranged at the medicament outlet. The second septum is pierced upon attaching a pen needle to the pump unit. Both the second septum and the pump serve for avoiding delayed dripping of medicament after injection. By means of the second septum and the pen needle the pump unit may be used for delivering more than one bolus of medicament while the interior of the pump unit is kept sterile between administration of the boluses.

The pump unit or the reusable backend or the injection arrangement may preferably be used for delivering one of an analgetic, an anticoagulant, insulin, an insulin derivate, heparin, Lovenox, a vaccine, a growth hormone and a peptide hormone.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Corresponding parts are marked with the same reference symbols in all figures.

Figure 1:
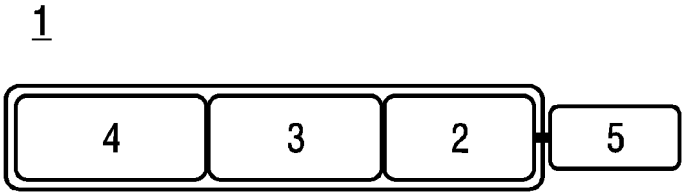
FIG. 1 is a schematic view of a pump unit comprising a pump, a flow sensor and a medicament container.

FIG. 1 shows a pump unit 1 comprising a pump 2, a flow sensor 3 and a medicament container 4. A hollow injection needle 5 is attached to the pump unit 1.

Figure 3:
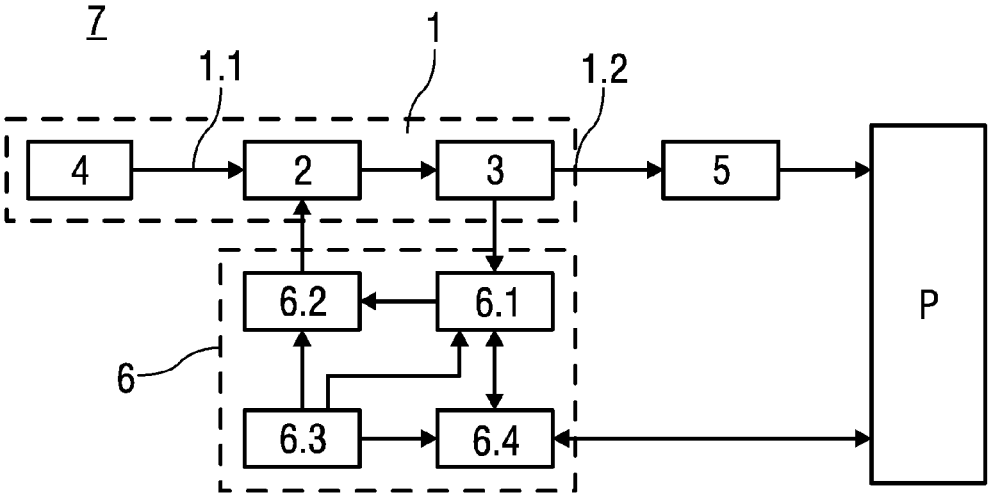
FIG. 3 is a schematic view of an injection arrangement.

The pump unit 1 is replaceably attachable to a reusable backend 6 (shown in FIG. 3) of an injection arrangement 7 (shown in FIG. 3) for delivering a liquid medicament.

The pump unit 1 comprises a medicament inlet 1.1, a medicament outlet 1.2 and the pump 2 for delivering the liquid medicament from the inlet 1.1 to the outlet 1.2. The medicament container 4 is arranged in the pump unit 1 and connectable to the medicament inlet 1.1. A fluid communication between the medicament container 4 and the pump 2 is establishable when the pump unit 1 is attached to the reusable backend 6. As long as the pump unit 1 is not attached to the reusable backend 6, the medicament container 4 remains sealed, e.g. by a septum (not shown). The fluid communication may be established by mechanically causing a relative advancing movement of the medicament container 4 towards a hollow needle (not shown) for piercing the septum, the needle attached to the medicament inlet 1.1.

The at least one hollow injection needle 5 may be a pen needle or a Luer needle or a micro-needle of a needle array.

The medicament container 4 may have the shape of a standard ampoule or be a container with a flexible wall.

The flow sensor 3 serves for determining a volume flow of the medicament. It is connectable to a control unit 6.1 of the reusable backend 6.

The flow sensor 3 may be a thermal sensor or a magnetically inductive sensor or an impeller sensor.

The pump 2 may be a peristaltic pump or a gear pump or a diaphragm pump.

The pump unit 1 may further have at least one interface for connecting to the reusable backend 6. The interface may be one of a mechanical, electrical, optical, acoustic, magnetic and wireless electromagnetic interface. Preferably the interfaces are arranged to be easily disconnectable.

The mechanical interface may be arranged for connecting the pump 2 to a drive unit 6.2 arranged in the reusable backend 6 for driving the pump 2. This mechanical interface may have the shape of a gear 1.3 (cf. FIG. 2) or a clutch.

The reusable backend further comprises an energy source 6.3 for powering the drive unit 6.2.

The energy source 6.3 for the drive unit 6.2 may be a galvanic cell or battery of galvanic cells in case the drive unit 6.2 comprises an electrical motor. Preferably the energy source 6.3 is a rechargeable accumulator. The rechargeable accumulator may be replaceable or chargeable in place by an external charging device (not shown) arranged for holding the reusable backend 6.

The reusable backend 6 may further have a user interface 6.4 for user interaction. This may comprise a dosing and/or trigger knob or wheel and/or a display, e.g for displaying a dose volume.

The pump unit 1 or the reusable backend 6 or the injection arrangement 7 may preferably be used for delivering one of an analgetic, an anticoagulant, insulin, an insulin derivate, heparin, Lovenox, a vaccine, a growth hormone and a peptide hormone.

For performing an injection a user sets a required target dose at the user interface 6.4. The required target dose is forwarded to the control unit 6.1 and stored there. As soon as the user triggers the injection arrangement 7, e.g by pressing the knob, the target dose is converted into a flow sensor setpoint and the drive unit 6.2 is started. The drive unit 6.2 converts the electrical energy provided by the energy source 6.3 into mechanical energy and forwards it to the pump 2. There the energy is again converted into fluidic energy causing a volume flow of the medicament. The integrated flow sensor 3 acquires the volume flow and forwards measurement values to the control unit 6.1. The measurement values, particularly when in the shape of increments corresponding to volume increments may be integrated by the control unit 6.1 and the drive unit 6.2 switched off upon delivery of the setpoint volume. After delivery the control unit 6.1 may generate a message for the user to be displayed by the display unit.

A second septum may be arranged at the medicament outlet 1.2. The second septum is pierced upon attaching a pen needle to the pump unit 1.

The hollow injection needle 5 for piercing a patient's (P) skin may be part of the pump unit 1. Alternatively, an adapter 8 for the hollow injection needle 5 may be integrated in the pump unit as shown in FIG. 2.

Figure 2:
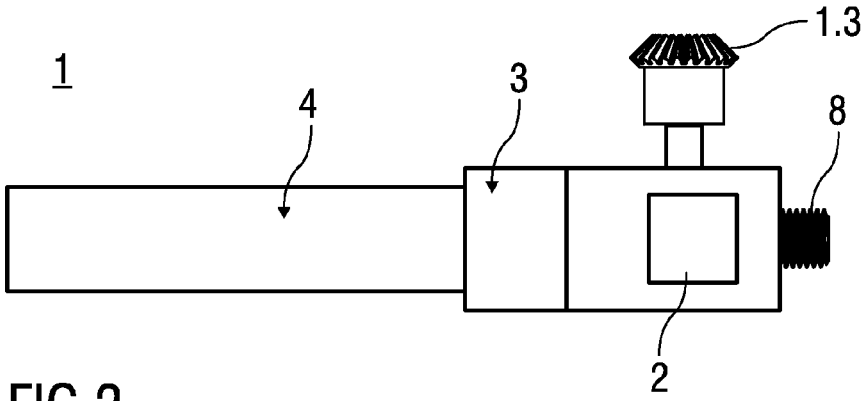
FIG. 2 is a lateral view of an embodiment of the pump unit.

The flow sensor 3 may be arranged downstream from the pump 2 (cf. FIG. 3) or upstream from the pump 2 (cf. FIGS. 1, 2).

When the pump 2 is arranged as a peristaltic pump, the peristaltic pump may comprise a pump rotor and a pump hose, e.g. a silicone hose. The pump hose is partially arranged around a perimeter of the pump rotor. The pump rotor exhibits protrusions, rollers, shoes or wipers for engaging the pump hose. In this case the pump unit 1 may have a fixing side facing the reusable backend 6, the fixing side having a recess in the shape of a circular arc for allowing a correspondingly shaped stop protruding from the reusable backend 6 to enter into the pump unit 1. When the pump unit 1 and the reusable backend 6 are assembled, the stop supports the pump hose from an outer side opposite the pump rotor. Thus the protrusions are allowed to locally squeeze the pump hose against the stop. When the rotor is rotated the protrusions are advanced along the pump hose thus advancing the squeezed portions of the hose and the fluid (air or the liquid medicament) in the hose ahead of the respective squeezed portion in rotational direction. Consequently, the fluid is forced out of the medicament outlet 1.2. At the same time a vacuum is created behind the advancing squeezed portion thus intaking fluid from the medicament inlet 1.1. When the pump unit 1 is not attached to the reusable backend 6, the pump hose is free to relax because of the clearance in place of the stop so the protrusions have nothing to squeeze the pump hose against.

In an alternative peristaltic pump the pump hose may be replaced by a pump chamber comprising an elongate cavity defined between an elastically deformable chamber wall and an essentially rigid chamber wall. The elastically deformable wall and the rigid wall are arranged as a one-piece part by two-component injection moulding. Preferably the elastically deformable chamber wall has essentially the shape of a lengthwise split cylinder and the rigid chamber wall has an essentially planar shape at least in sections of the elongate cavity, so a pump rotor in a rotary design or a another squeezing tool in a linear pump design may press the elastically deformable chamber wall against the rigid chamber wall without leaving a considerable gap between the two parts.

In a rotary pump design the elongate cavity and thus the deformable and the rigid wall are at least partially arranged in a circular arc shape so as to allow the pump rotor of the peristaltic pump to engage a considerable length of the elastically deformable wall.

The term "medicament", as used herein, means a pharmaceutical formulation containing at least one pharmaceutically active compound, wherein in one embodiment the pharmaceutically active compound has a molecular weight up to 1500 Da and/or is a peptide, a proteine, a polysaccharide, a vaccine, a DNA, a RNA, a antibody, an enzyme, an antibody, a hormone or an oligonucleotide, or a mixture of the above-mentioned pharmaceutically active compound, wherein in a further embodiment the pharmaceutically active compound is useful for the treatment and/or prophylaxis of diabetes mellitus or complications associated with diabetes mellitus such as diabetic retinopathy, thromboembolism disorders such as deep vein or pulmonary thromboembolism, acute coronary syndrome (ACS), angina, myocardial infarction, cancer, macular degeneration, inflammation, hay fever, atherosclerosis and/or rheumatoid arthritis, wherein in a further embodiment the pharmaceutically active compound comprises at least one peptide for the treatment and/or prophylaxis of diabetes mellitus or complications associated with diabetes mellitus such as diabetic retinopathy, wherein in a further embodiment the pharmaceutically active compound comprises at least one human insulin or a human insulin analogue or derivative, glucagon-like peptide (GLP-1) or an analogue or derivative thereof, or exedin-3 or exedin-4 or an analogue or derivative of exedin-3 or exedin-4.

Insulin analogues are for example Gly(A21), Arg(B31), Arg(B32) human insulin; Lys(B3), Glu(B29) human insulin; Lys(B28), Pro(B29) human insulin; Asp(B28) human insulin; human insulin, wherein proline in position B28 is replaced by Asp, Lys, Leu, Val or Ala and wherein in position B29 Lys may be replaced by Pro; Ala(B26) human insulin; Des(B28-B30) human insulin; Des(B27) human insulin and Des(B30) human insulin.

Insulin derivates are for example B29-N-myristoyl-des(B30) human insulin; B29-N-palmitoyl-des(B30) human insulin; B29-N-myristoyl human insulin; B29-N-palmitoyl human insulin; B28-N-myristoyl LysB28ProB29 human insulin; B28-N-palmitoyl-LysB28ProB29 human insulin; B30-N-myristoyl-ThrB29LysB30 human insulin; B30-N-palmitoyl-ThrB29LysB30 human insulin; B29-N—(N-palmitoyl-Y-glutamyl)-des(B30) human insulin; B29-N—(N-lithocholyl-Y-glutamyl)-des(B30) human insulin; B29-N-(ω-carboxyheptadecanoyl)-des(B30) human insulin and B29-N-(ω-carboxyheptadecanoyl) human insulin.

Exendin-4 for example means Exendin-4(1-39), a peptide of the sequence H His-Gly-Glu-Gly-Thr-Phe-Thr-Ser-Asp-Leu-Ser-Lys-Gln-Met-Glu-Glu-Glu-Ala-Val-Arg-Leu-Phe-Ile-Glu-Trp-Leu-Lys-Asn-Gly-Gly-Pro-Ser-Ser-Gly-Ala-Pro-Pro-Pro-Ser-NH2.

Exendin-4 derivatives are for example selected from the following list of compounds:

H-(Lys)4-des Pro36, des Pro37 Exendin-4(1-39)-NH2,
H-(Lys)5-des Pro36, des Pro37 Exendin-4(1-39)-NH2,
des Pro36[Asp28] Exendin-4(1-39),
des Pro36 [IsoAsp28] Exendin-4(1-39),
des Pro36 [Met(O)14, Asp28] Exendin-4(1-39),
des Pro36 [Met(O)14, IsoAsp28] Exendin-4(1-39),
des Pro36 [Trp(O2)25, Asp28] Exendin-4(1-39),
des Pro36 [Trp(O2)25, IsoAsp28] Exendin-4(1-39),
des Pro36 [Met(O)14 Trp(O2)25, Asp28] Exendin-4(1-39),
des Pro36 [Met(O)14 Trp(O2)25, IsoAsp28] Exendin-4(1-39); or
des Pro36 [Asp28] Exendin-4(1-39),
des Pro36 [IsoAsp28] Exendin-4(1-39),
des Pro36 [Met(O)14, Asp28] Exendin-4(1-39),
des Pro36 [Met(O)14, IsoAsp28] Exendin-4(1-39),
des Pro36 [Trp(O2)25, Asp28] Exendin-4(1-39),
des Pro36 [Trp(O2)25, IsoAsp28] Exendin-4(1-39),
des Pro36 [Met(O)14 Trp(O2)25, Asp28] Exendin-4(1-39),
des Pro36 [Met(O)14 Trp(O2)25, IsoAsp28] Exendin-4(1-39), wherein the group -Lys6-NH2 may be bound to the C-terminus of the Exendin-4 derivative;

or an Exendin-4 derivative of the sequence

H-(Lys)6-des Pro36 [Asp28] Exendin-4(1-39)-Lys6-NH2,
des Asp28 Pro36, Pro37, Pro38Exendin-4(1-39)-NH2,
H-(Lys)6-des Pro36, Pro38 [Asp28] Exendin-4(1-39)-NH2,
H-Asn-(Glu)5des Pro36, Pro37, Pro38 [Asp28] Exendin-4(1-39)-NH2,
des Pro36, Pro37, Pro38 [Asp28] Exendin-4(1-39)-(Lys)6-NH2,
H-(Lys)6-des Pro36, Pro37, Pro38 [Asp28] Exendin-4(1-39)-(Lys)6-NH2,
H-Asn-(Glu)5-des Pro36, Pro37, Pro38 [Asp28] Exendin-4(1-39)-(Lys)6-NH2,
H-(Lys)6-des Pro36 [Trp(O2)25, Asp28] Exendin-4(1-39)-Lys6-NH2,
H-des Asp28 Pro36, Pro37, Pro38 [Trp(O2)25] Exendin-4(1-39)-NH2,
H-(Lys)6-des Pro36, Pro37, Pro38 [Trp(O2)25, Asp28] Exendin-4(1-39)-NH2,
H-Asn-(Glu)5-des Pro36, Pro37, Pro38 [Trp(O2)25, Asp28] Exendin-4(1-39)-NH2,
des Pro36, Pro37, Pro38 [Trp(O2)25, Asp28] Exendin-4(1-39)-(Lys)6-NH2,
H-(Lys)6-des Pro36, Pro37, Pro38 [Trp(O2)25, Asp28] Exendin-4(1-39)-(Lys)6-NH2,
H-Asn-(Glu)5-des Pro36, Pro37, Pro38 [Trp(O2)25, Asp28] Exendin-4(1-39)-(Lys)6-NH2,
H-(Lys)6-des Pro36 [Met(O)14, Asp28] Exendin-4(1-39)-Lys6-NH2,
des Met(O)14 Asp28 Pro36, Pro37, Pro38 Exendin-4(1-39)-NH2,
H-(Lys)6-desPro36, Pro37, Pro38 [Met(O)14, Asp28] Exendin-4(1-39)-NH2,
H-Asn-(Glu)5-des Pro36, Pro37, Pro38 [Met(O)14, Asp28] Exendin-4(1-39)-NH2,
des Pro36, Pro37, Pro38 [Met(O)14, Asp28] Exendin-4(1-39)-(Lys)6-NH2,
H-(Lys)6-des Pro36, Pro37, Pro38 [Met(O)14, Asp28] Exendin-4(1-39)-(Lys)6-NH2,
H-Asn-(Glu)5 des Pro36, Pro37, Pro38 [Met(O)14, Asp28] Exendin-4(1-39)-(Lys)6-NH2,
H-Lys6-des Pro36 [Met(O)14, Trp(O2)25, Asp28] Exendin-4(1-39)-Lys6-NH2,
H-des Asp28 Pro36, Pro37, Pro38 [Met(O)14, Trp(O2)25] Exendin-4(1-39)-NH2,
H-(Lys)6-des Pro36, Pro37, Pro38 [Met(O)14, Asp28] Exendin-4(1-39)-NH2,
H-Asn-(Glu)5-des Pro36, Pro37, Pro38 [Met(O)14, Trp(O2)25, Asp28] Exendin-4(1-39)-NH2, des Pro36, Pro37, Pro38 [Met(O)14, Trp(O2)25, Asp28] Exendin-4(1-39)-(Lys)6-NH2, H-(Lys)6-des Pro36, Pro37, Pro38 [Met(O)14, Trp(O2)25, Asp28] Exendin-4(S1-39)-(Lys)6-NH2, H-Asn-(Glu)5-des Pro36, Pro37, Pro38 [Met(O)14, Trp (O2)25, Asp28] Exendin-4(1-39)-(Lys)6-NH2;

or a pharmaceutically acceptable salt or solvate of any one of the afore-mentioned Exedin-4 derivative.

Hormones are for example hypophysis hormones or hypothalamus hormones or regulatory active peptides and their antagonists as listed in Rote Liste, ed. 2008, Chapter 50, such as Gonadotropine (Follitropin, Lutropin, Choriongonadotropin, Menotropin), Somatropine (Somatropin), Desmopressin, Terlipressin, Gonadorelin, Triptorelin, Leuprorelin, Buserelin, Nafarelin, Goserelin.

A polysaccharide is for example a glucosaminoglycane, a hyaluronic acid, a heparin, a low molecular weight heparin or an ultra low molecular weight heparin or a derivative thereof, or a sulphated, e.g. a poly-sulphated form of the above-mentioned polysaccharides, and/or a pharmaceutically acceptable salt thereof. An example of a pharmaceutically acceptable salt of a poly-sulphated low molecular weight heparin is enoxaparin sodium.

Pharmaceutically acceptable salts are for example acid addition salts and basic salts. Acid addition salts are e.g. HCl or HBr salts. Basic salts are e.g. salts having a cation selected from alkali or alkaline, e.g. Na+, or K+, or Ca2+, or an ammonium ion N+(R1)(R2)(R3)(R4), wherein R1 to R4 independently of each other mean: hydrogen, an optionally substituted C1 C6-alkyl group, an optionally substituted C2-C6-alkenyl group, an optionally substituted C6-C10-aryl group, or an optionally substituted C6-C10-heteroaryl group. Further examples of pharmaceutically acceptable salts are described in "Remington's Pharmaceutical Sciences" 17. ed. Alfonso R. Gennaro (Ed.), Mark Publishing Company, Easton, Pa., U.S.A., 1985 and in Encyclopedia of Pharmaceutical Technology.

Pharmaceutically acceptable solvates are for example hydrates.

LIST OF REFERENCES

1 pump unit
- medicament inlet
- medicament outlet
- gear

2 pump
3 flow sensor
4 medicament container
5 hollow injection needle
6 reusable backend
- control unit
- drive unit
- energy source
- user interface

7 injection arrangement
8 adapter

The invention claimed is:

1. Pump unit, replaceably attachable to a reusable backend of an injection arrangement for delivering a liquid medicament, the pump unit comprising a medicament inlet, a medicament outlet and a pump for delivering the liquid medicament from the inlet to the outlet, and a medicament container comprising a septum, wherein a fluid communication between the medicament container and the pump can only be established when the pump unit is attached to the reusable backend, by mechanically causing a movement of the medicament container with respect to the pump of the pump unit for delivery of the liquid medicament from the inlet to the outlet, wherein the septum of the medicament container remains sealed as long as the pump unit is not attached to the reusable backend.

2. Pump unit, according to claim 1, characterized in that at least one hollow injection needle for piercing a patient's (P) skin and administering the medicament or an adapter for attaching the at least one hollow injection needle is integrated in the pump unit.

3. Pump unit, according to claim 2, characterized in that the needle is a pen needle or a Luer needle or a micro-needle of a needle array.

4. Pump unit according to claim 1, characterized in that a flow sensor for determining a volume flow of the medicament is arranged in the pump unit and connectable to a control unit of a reusable backend.

5. Pump unit according to claim 4, characterized in that the flow sensor is a thermal sensor or a magnetically inductive sensor or an impeller sensor.

6. Pump unit according to claim 1, characterized in that the pump is a peristaltic pump or a gear pump or a diaphragm pump.

7. Pump unit according to claim 1, characterized in that at least one interface to the reusable backend is provided, wherein the interface is one of a mechanical, electrical, optical, acoustic, magnetic and wireless electromagnetic interface.

8. Pump unit according to claim 7, characterized in that the mechanical interface is arranged for connecting the pump to a drive unit arranged in a reusable backend.

9. Pump unit according to claim 8, characterized in that the mechanical interface is a gear or a clutch.

10. Pump unit according to claim 1, wherein the fluid communication is established by mechanically causing a relative advancing movement of the medicament container towards a hollow needle for piercing the septum, wherein the hollow needle is attached to the medicament inlet.

11. Injection arrangement for delivering a liquid medicament, comprising a pump unit according to claim 1 and a reusable backend, comprising a control unit, a drive unit and an energy source.

12. Injection arrangement according to claim 11, characterized in that the energy source is a rechargeable accumulator.

13. Injection arrangement according to claim 12, characterized in that the rechargeable accumulator is chargeable by an external charging device arranged for holding the reusable backend.

14. Injection arrangement according to claim 11, characterized in that a user interface for user interaction is arranged in the reusable backend.

* * * * *